US006121610A

United States Patent [19]

Yoshinari et al.

[11] Patent Number: 6,121,610

[45] Date of Patent: Sep. 19, 2000

[54] ION TRAP MASS SPECTROMETER

[75] Inventors: Kiyomi Yoshinari, Hitachi; Yoichi Ose; Yoshiaki Kato, both of Mito, all of Japan

[73] Assignee: Hitachi, Ltd., Tokyo, Japan

[21] Appl. No.: 09/167,892

[22] Filed: Oct. 7, 1998

[30] Foreign Application Priority Data

Oct. 9, 1997 [JP] Japan ..... 9-277257

[51] Int. Cl.[7] ..... H01J 49/42

[52] U.S. Cl. ..... 250/292

[58] Field of Search ..... 250/292, 293, 250/290, 291

[56] References Cited

U.S. PATENT DOCUMENTS

| | | | |
|---|---|---|---|
| 4,685,367 | 8/1987 | Louris et al. . | |
| 4,736,101 | 4/1988 | Syka et al. . | |
| 4,771,172 | 9/1988 | Weber-Grabau et al. . | |
| 4,818,869 | 4/1989 | Weber-Grabau . | |
| 5,107,109 | 4/1992 | Stafford, Jr. et al. . | |
| 5,198,655 | 3/1993 | Suetsugu et al. . | |
| 5,291,017 | 3/1994 | Wang et al. . | |
| 5,302,826 | 4/1994 | Wells . | |
| 5,324,939 | 6/1994 | Louris et al. . | |
| 5,404,011 | 4/1995 | Wells et al. . | |
| 5,451,782 | 9/1995 | Kelley . | |
| 5,457,315 | 10/1995 | Wells et al. . | |
| 5,517,025 | 5/1996 | Wells et al. . | |
| 5,521,380 | 5/1996 | Wells et al. . | |
| 5,561,291 | 10/1996 | Kelley et al. . | |
| 5,608,216 | 3/1997 | Wells et al. . | |
| 5,623,144 | 4/1997 | Yoshinari et al. . | |
| 5,679,951 | 10/1997 | Kelley et al. . | |
| 5,710,427 | 1/1998 | Schubert et al. | 250/292 |
| 5,729,014 | 3/1998 | Mordehai et al. . | |
| 5,747,801 | 5/1998 | Quarmby et al. | 250/292 |
| 5,789,747 | 8/1998 | Kato et al. | 250/292 |

FOREIGN PATENT DOCUMENTS

| | | |
|---|---|---|
| 0350159 | 1/1990 | European Pat. Off. . |
| 10-27570 | 1/1998 | Japan . |

*Primary Examiner*—Kiet T. Nguyen
*Attorney, Agent, or Firm*—Kenyon & Kenyon

[57] ABSTRACT

By preventing the trapping efficiency of ions from largely depending on the mass-to-charge ratio, an ion trap mass spectrometer suitable for obtaining a high sensitive mass spectrum is provided. Ions of a specimen to be mass analyzed generated at an external ion source pass through an ion transportation portion and then injected into a space (ion trap volume) between the ring electrode and the end cap electrodes. An RF trap voltage power source applies an RF frequency V·cos Ωt between the ring electrode and the end cap electrodes to form a radio frequency electric field in the ion trap volume. The RF trap voltage is changed so that the optimum trap frequency is in inverse proportion to 1/2 power of a mass-to-charge ratio while the ions are being trapped in the radio frequency electric field formed in the ion trap volume.

17 Claims, 17 Drawing Sheets

SIMULATION CONDITIONS

INNER RADINS OF RING ELECTRODE $r_0$:7mm
FREQUENCY OF RF VOLTAGE:909kHz
INJECTION ENERGY OF EXTERNALLY GENERATED IONS:5eV
He GAS:1mTorr

ION TRAP MASS SPECTROMETER

BACKGROUND OF THE INVENTION

The present invention relates to an ion trap mass spectrometer which performs mass analysis of trapped ions generated in external ion source and injected into an ion trap.

An ion trap mass spectrometer comprises a ring electrode and two end-cap electrodes arranged opposite in direction to each other sandwiching the ring electrode, as shown in FIG. 2. A direct current voltage U and a radio-frequency voltage V·cos Ωt are applied between the electrodes to form a quadrupole electric field in the electrode space. Stability of path of ions trapped in the electric field is determined by a dimension of the instrument (inner diameter $r_0$ of the ring electrode), the direct current voltage U, the amplitude V and the angular frequency Ω of the radio-frequency voltage applied to the electrodes, and values a and q given by a mass-to-charge ratio of an ion (Equation (1)).

$$a=\{8eU/r_0^2\Omega^2\}(Z/m),\ q=\{4eV/r_0^2\Omega^2\}(Z/m) \quad (1)$$

where Z is an ionic charge number, m is a mass of the ion, e is the elementary electric charge.

FIG. 3 shows a stability diagram expressed by the range of the values a and b giving stable trajectories in the ion trap volume (quadrupole electric field space). In general, since only the radio-frequency voltage V·cos Ωt (RF trap voltage) is applied to the ring electrode, all ions whose values a and q are on the straight line a=0 inside the stability region are stably oscillated and trapped inside the ion trap volume. At that time, the ions are different in (0, q) point on the stability region (FIG. 3) depending on the value of mass-to-charge ratio (m/Z), and sequentially aligned on the a-axis in the range of q=0~0.908 determined by Equation (1) from ions having a large value of mass-to-charge ratio to a small value of mass-to-charge ratio. Further, the oscillation characteristics of ion oscillations in the ion trap volume are different depending on the (a, q) point on the stability region (FIG. 3).

One type of the ion trap mass spectrometer is operated with a resonance ejection mode, in which by using the phenomenon that ions oscillate with different frequency depending on a mass-to-charge ratio m/Z, an auxiliary alternating current electric field having a specific frequency is generated in the ion trap volume, and only the oscillation of ions resonating with the auxiliary alternating current electric field is amplified to mass separate the ion species by ejecting from the ion trap volume.

There are various types other than the above. In these types of the ion trap mass spectrometers, a mass distribution of ions composing a specimen can be measured by detecting the mass-to-charge ratio m/Z of ions which are mass separated and ejected.

There are two kinds of means for trapping ions of a specimen to be mass analyzed in an ion trap volume. That is, as described in Japanese Patent Application Laid-Open No.62-37861 and Japanese Patent Application Laid-Open No.2-103856, one method is that a neutral specimen to be mass analyzed is injected into an ion trap volume, and ionized in the ion trap volume by electron collision or the like, and then directly trapped in the ion trap volume; and the other method is that ions generated in an ion source external of an ion trap are injected in an ion trap volume to be trapped. During an ion injecting period (trapping period= storing-up period) (A) shown in FIG. 4, ion generation and stable trapping of ions are performed in a case of the former type, and ion injection and stable trapping of ions generated in the external ion source is performed in a case of the latter type. That is, even in the case where ions are generated in the external and the generated ions are injected into the ion trap volume, an RF trap voltage having a constant amplitude is generally applied during the ion injection period, as shown in FIG. 4.

SUMMARY OF THE INVENTION

In a case where mass analysis is performed by injecting externally generated ions into an ion trap volume, a the trapping efficiencies of injected ions into the ion trap volume (trapping efficiency) defers depending on an amplitude V of the radio-frequency voltage V·cos Ωt applied to the ring electrode during injecting the ions, and also an amplitude V of an RF trap voltage giving the maximum sensitivity (an optimum RF voltage) is depending on a mass-to-charge ratio of ions (ion spices). FIG. 5 shows the relationship between trapping efficiency of ions and amplitude of RF trap voltage for single charged ions (Z=1) of 100 amu to 1000 amu. This relationship is obtained from numerical analysis. The data is obtained under a condition that ions are injected through a central hole of an end cap and the injection energy is set to 5 eV and frequency of the RF trap voltage is set to 909 kHz.

Whether or not the ions are trapped largely depends on the ion injection timing to the phase ($\phi_t$) in one cycle of the RF voltage ($V\cos(\Omega t+\phi_t)$). Further, since the ions are continuously injected during a determined time (period) regardless of the phase $\phi_t$ of the trapping electric field in an actual case, it can be considered that the trapping efficiency is given by an average value of the oscillation cycle of the trapping electric field. Hereinafter, the trapping efficiency is evaluated using Equation (2). The trapping efficiencies shown in FIG. 5 are values obtained using Equation (2)

$$T=\frac{\int_0^{2\pi} P(\phi_t)\,d\phi_t}{2\pi} \quad (2)$$

where $P(\phi_t)$ expresses a trapping efficiency of ions when a phase of the trapping electric field is $\phi_t$.

It is clear from FIG. 5 that there exists a RF trap voltage (an optimum trap voltage) at which the trapping efficiency becomes maximum and the optimum value is different depending on the ion species. For example, when the RF trap voltage is set to an optimum trap voltage value to the ions of M=100 amu, the trapping efficiencies for ions above 300 amu become very small. A mass spectrum obtained in such a case can be measured in high sensitivity for a low mass number ion, but is measured in poor sensitivity for a high mass number ion, as shown in FIG. 6. In such a case, even an ion species actually existing in high amounts in a specimen shows a low sensitivity mass spectrum depending on the injection condition (trap condition=storing-up condition), and accordingly an erroneous analysis result may be obtained. Therefore, in the conventional method in which a constant RF trap voltage is applied during ion injection period, the trapping efficiency, that is, the sensitivity largely differs among different ion species, and consequently there occurs a problem in accuracy and reliability of the mass analysis result. Such a problem does not occur in an ion-trap mass spectrometer in which ions are generated inside an ion trap volume, and accordingly the problem is a specific problem for an ion-trap mass spectrometer in which ions are generated outside an ion trap volume and the generated ions are injected into the ion trap volume.

An object of the present invention is to provide an ion-trap mass spectrometer performing mass analysis by injecting ions generated outside an ion trap volume into the ion trap volume and trapping the ions, which prevents the trapping efficiency of ions from largely depending on the mass-to-charge ratio, and thereby, is suitable for obtaining a high sensitivity mass spectrum, substantially independently of ion masses.

In an ion trap mass spectrometer in which ions generated outside an ion trap volume are injected into the ion trap volume to be trapped, the ion trap mass spectrometer in accordance with the present invention successively changes a radio frequency electric field formed in the ion trap volume during ion injection and trap period. In detail, a simplest example is that an optimum trap voltage is successively changed during ion injection and trap period so as to be in approximately proportion to 1/2 power of a mass-to-charge ratio of ions within the mass range to be mass analyzed, or an optimum frequency of the RF voltage is successively changed so as to be in approximately inverse proportion to 1/2 power of a mass-to-charge ratio of ions within the mass range to be mass analyzed.

According to the above method, the ion trapping efficiency becomes substantially constant through the ion trap period practically regardless of the mass-to-charge ratio of ions, and consequently it is possible to obtain a substantially equal sensitivity on mass spectra among different ion species.

The amplitude or the frequency of the RF voltage may be changed so as to be increase or decreased with time.

The amplitude or the frequency of the RF voltage may be changed so as to be repeated to increase and decrease with time.

The amplitude or the frequency of the RF voltage may be changed so that a rate of the change with time is constant.

The amplitude or the frequency of the RF voltage may be changed so that a rate of the change with time is changed.

The amplitude or the frequency if the RF voltage may be changed so that the change is repeated.

The amplitude or the frequency of the RF voltage may be changed in a step-shape.

Another feature of the present invention is an ion trap mass spectrometer comprising a ring electrode; end cap electrodes arranged opposite to each other so that the ring electrode is interposed between the end cap electrodes; a radio frequency power source for generating a radio frequency voltage applied to the ring electrode and the end cap electrodes so as to form a radio frequency electric field in an ion trap volume formed between the ring electrode and the end cap electrodes; and a means for generating ions and injecting the ions into the ion trap volume during a first period, the ions being injected into and trapped in the ion trap volume, the trapped ions being ejected from the ion trap volume during a predetermined second period, wherein a predetermined range of mass-to-charge ratio of ions within the mass range to be mass analyzed is divided into a plurality of divided mass ranges, the introduction of the ions during the first period and the emission of the ions during the second period being performed to each of the plurality of divided mass ranges, the amplitude or the frequency of the radio frequency electric field being successively changed while the injection and the trapping of the ions are being performed during the first period.

The amplitude or the frequency of the radio frequency electric field may be changed in each of the plurality of divided ranges of the mass-to-charge ratio of ions to be analyzed on each base of a different constant value.

A further feature of the present invention is an ion trap mass spectrometer comprising a ring electrode; end cap electrodes arranged opposite to each other so that the ring electrode is interposed between the end cap electrodes; a radio frequency power source for generating a radio frequency voltage applied to the ring electrode and the end cap electrodes so as to form a radio frequency electric field in an ion trap volume formed between the ring electrode and the end cap electrodes; and a means for generating ions and injection the ions into the ion trap volume during a predetermined period, the ions being injected into and trapped in the ion trap volume, the trapped ions being ejected from the ion trap volume, wherein as a mass-to-charge ratio of ions to be injected is increased, amplitude of the radio frequency voltage is successively changed during the predetermined ion injection period so that the change speed of the amplitude during the ion injection period becomes higher.

DESCRIPTION OF THE PREFERRED EMBODIMENTS

Figure 1:
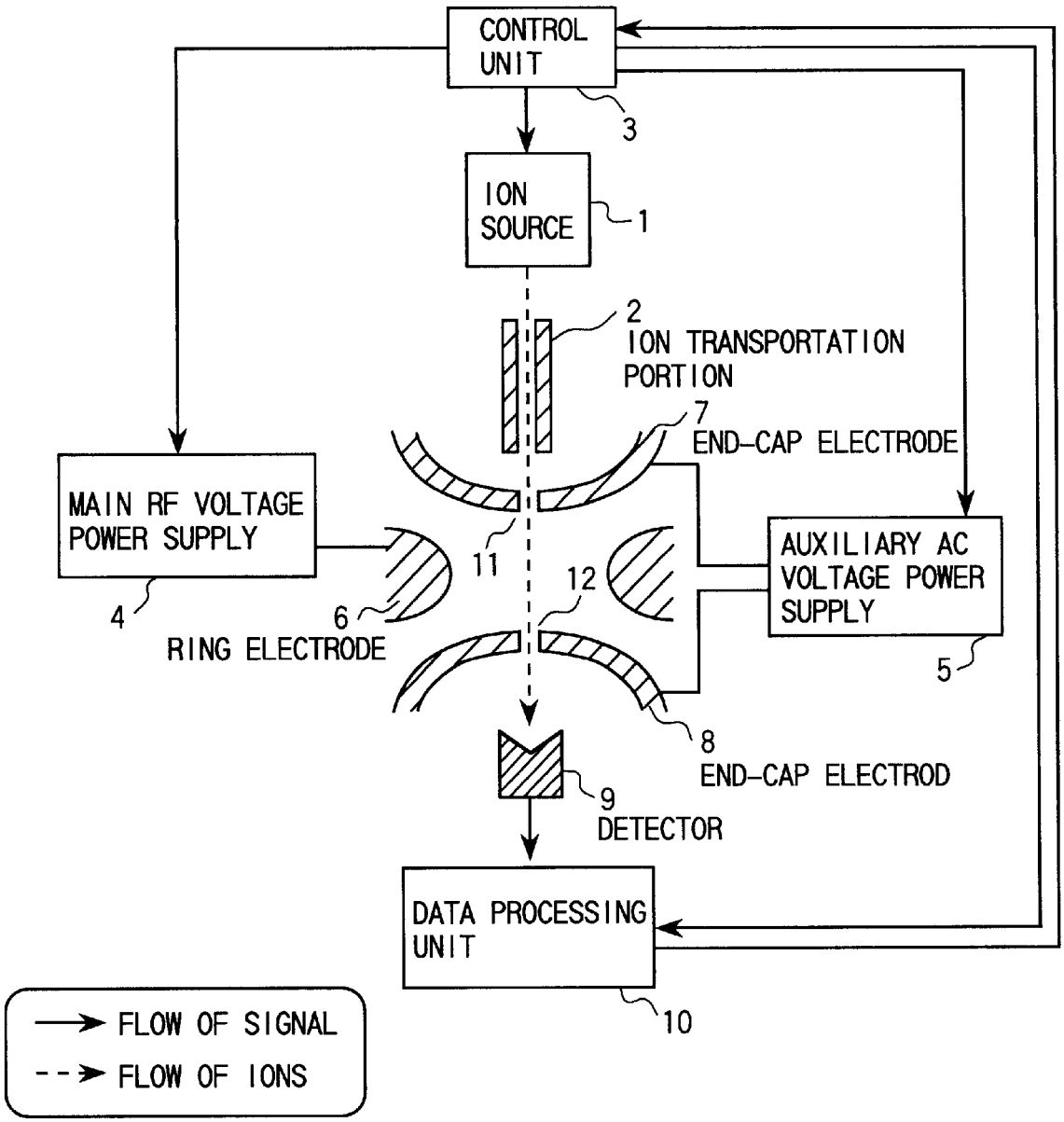
FIG. 1 is a schematic view showing a first embodiment of an ion trap mass spectrometer in accordance with the present invention.
Figure 2:
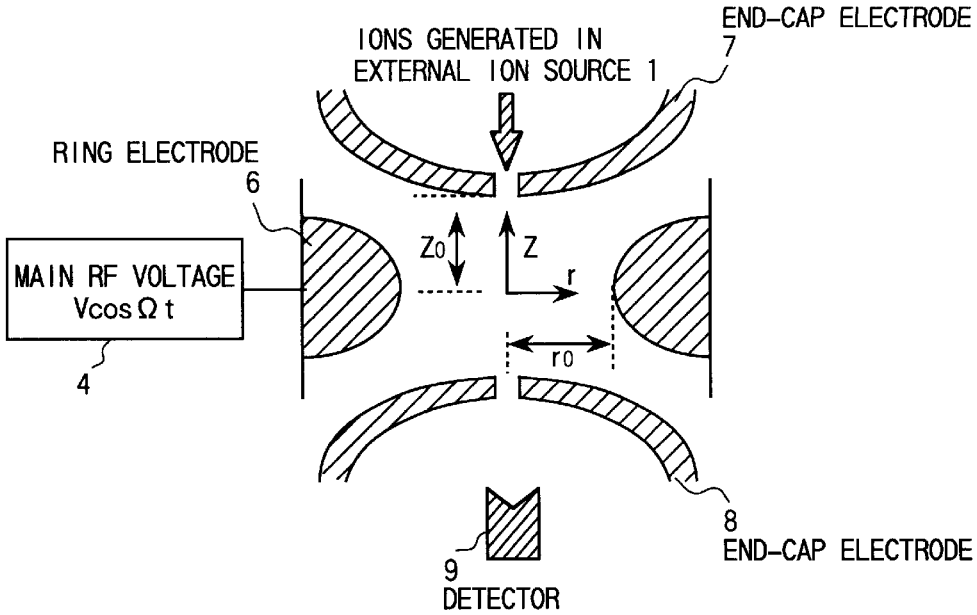
FIG. 2 is a cross-sectional view showing the electrodes of the ion trap of FIG. 1.

A first embodiment of the present invention will be described below. FIG. 1 is a schematic view showing a first embodiment of an ion trap mass spectrometer in accordance with the present invention.

An ion trap electrode is composed of a ring electrode 6, and two end cap electrodes 7, 8 arranged opposite to each other sandwiching the ring electrode. Ions of a specimen to be mass analyzed generated at an external ion source 1 pass through an ion transportation portion 2 and then through a central aperture 11 of the end cap electrode 7 to be injected into a space (ion trap volume) between the ring electrode 6 and the end cap electrodes 7, 8. At that time, a radio frequency electric field of three-dimensional quadrupole electric field is formed in the ion trap volume by a radio-frequency voltage $V \cdot \cos \Omega t$ applied between the ring electrode 6 and the end cap electrodes 7, 8. The end cap electrodes 7, 8 are kept in a grounded voltage while the ions are being injected into the ion trap volume (quadrupole electric field space).

Figure 10:
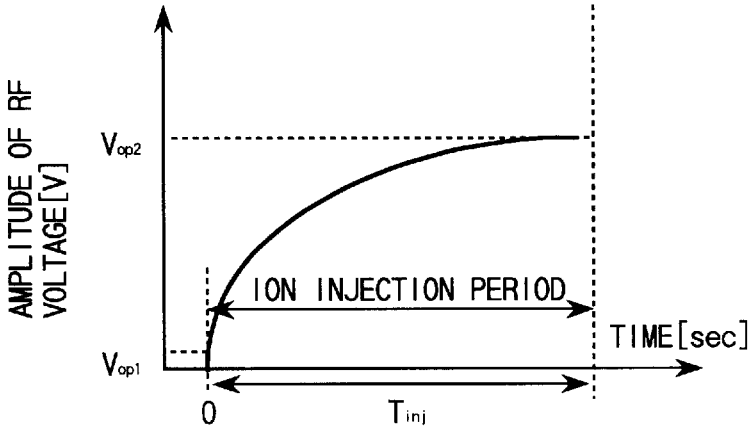
FIG. 10 is a diagram showing amplitude of RF trap voltage versus time in a first embodiment of a method of changing RF voltage during ion injection period (trapping period) in accordance with the present invention.

The time (period) shown in FIG. 10 is a period to inject the ions, and is also a period to stably restrain the injected (introduced) ions between the electrodes. As shown in FIG. 10, ions having mass-to-charge ratios within a predetermined range are injected into the ion trap volume and stably restricted in the ion trap volume, and then ions having a specific mass-to-charge ratio are mass separated and come out from the ion trap volume to be detected.

As a method of mass separation, as shown in FIG. 1, by applying an auxiliary alternating current voltage between the end cap electrodes 7, 8 from an auxiliary alternating current voltage source 5, ion species (ions having the same mass-to-charge ratio) resonated with the generated auxiliary alternating current electric field are ejected (resonance ejection). The mass separated ions are ejected from the ion trap volume according to their mass-to-charge ratio through the center aperture 11 of the end cap electrode 7 or a center aperture 12 of the end cap electrode 8. The ions ejected through the center aperture 12 are detected by a detector 9, and a signal of the detected ions is processed by a data processing unit 10. A control unit 3 controls this series of mass analysis processes, that is, all of the specimen ion injection and trap, adjustment of the amplitude of the RF trap voltage during the ion injection period, adjustment of the amplitude and kind and timing of applying the auxiliary alternating current voltage, the detection and the data processing.

Figure 7:
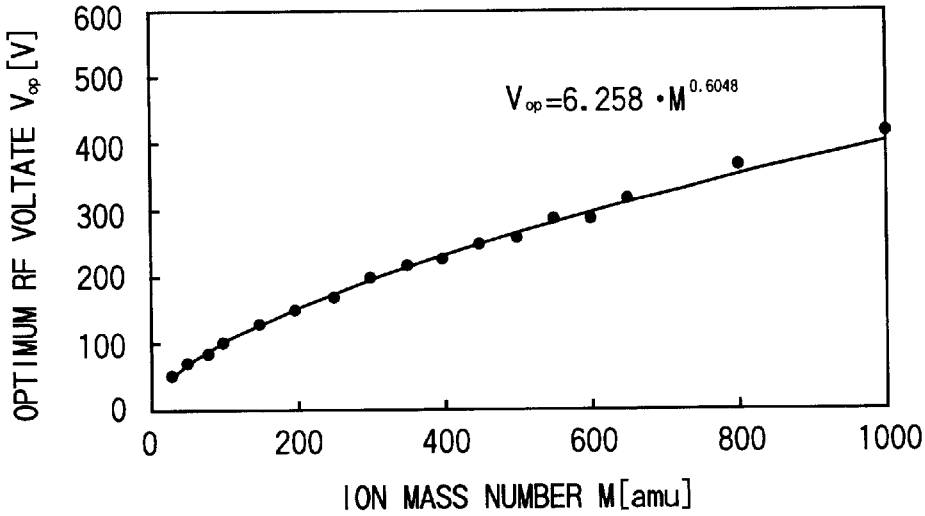
FIG. 7 is a diagram showing the relationship between the optimum trap voltage at which the trapping efficiency becomes a maximum and ion mass number obtained from the analysis result of FIG. 6.
Figure 11:
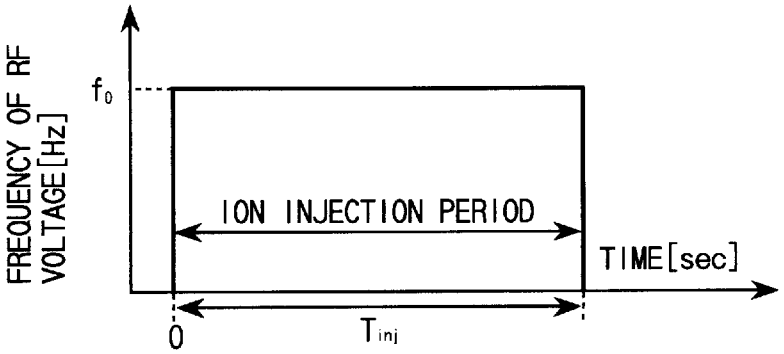
FIG. 11 is a diagram showing conventional frequency of RF trap voltage versus time in a second embodiment of a method of changing RF trap voltage during ion injection period in accordance with the present invention.

A method of applying the RF trap voltage during ion injection period (trap period) in the present embodiment will be described below, referring to FIG. 10 and FIG. 11. In this embodiment, the amplitude of the RF trap voltage applied to the ring electrode is gradually increased during the period of injecting and trapping the ions generated the outside (ion injection and trap period), as shown in FIG. 10. On the other hand, the frequency of the RF trap voltage is kept in a constant value throughout the ion trap period and the mass separation period (FIG. 11). The method of increasing the amplitude of the RF trap voltage during the ion injection period (trap period) will be described below. In FIG. 7, there is shown an approximation equation (Equation (3)) expressing the relationship between the mass-to-charge ratio M obtained from numerical analysis and the optimum trap voltage $V_{op}$ giving the maximum trapping efficiency during the ion injection period.

$$V_{op}=6.258\cdot M^{0.6048} \tag{3}$$

This equation is calculated under assumption that the ion valence number Z is 1, the inner radius of the ring electrode $r_0$ is 7 mm, the frequency f (=Ω/2π) of the RF trap voltage is 909 kHz, the helium gas pressure $P_{He}$ is 1 motor, and the ion injection energy $E_n$ is 5 eV. It can be understood from the approximation equation that the optimum trap voltage $V_{op}$ is nearly in proportion to 1/2 power of the mass-to-charge ratio of ions. From the approximate equation, an optimum trap voltage range corresponding to all ion species within a predetermined ranges of the mass-to-charge ratio m/Z, and the RF trap voltage is gradually increased during the ion injection period within the range. Further, the optimum trap voltage $V_{op}$ may be also expressed by an approximate equation of power of the mass-to-charge ratio m/Z.

$$V_{op}=C\cdot(m/Z)^{Ox} \text{ (C: proportional constant, } 0<Xo\leqq 1) \tag{4}$$

Similarly, in this case, an optimum trap voltage range corresponding to all ion species within a predetermined range of the mass-to-charge ratio, and the RF trap voltage is gradually increased during the ion trap period within the range. The method of increasing the RF trap voltage is that, for example, in a case where the predetermined range of the mass-to-charge ratio is m1 to m2 under assumption of singly charged ions, the range of the optimum trap voltage $V_{op}$ becomes $V_{op}1$ to $V_{op}2$ from Equation (3) or Equation (4) (refer to Equation (4')).

$$V_{opi}=C\cdot m_i^{Xo} \text{ (i=1, 2)} \tag{4'}$$

In a case where an objective ion species m is changed in proportion to time t as shown by Equation (5) during ion injection time (trap period) $T_{inj}$ when the RF trap voltage applied to the ring electrode is set to the optimum trap voltage for all ion species within the mass range, the RF trap voltage V is applied so as to satisfy the following equation (Equation (6)) with time t in order to always keep the RF trap voltage within the optimum trap voltage for the ion species within the predetermined range.

$$m=\frac{m_2-m_1}{T_{inj}}t+m_1 \tag{5}$$

-continued $$V_{op}=C\cdot\left(\frac{m_2-m_1}{T_{inj}}t+m_1\right)^{Xo} \tag{6}$$

(C: proportional constant, $Ox \leqq 1$)

FIG. 10 shows the method of applying the RF trap voltage during the ion injection period based on the above correlation equation. The amplitude V of the RF trap voltage during the ion injection period $T_{inj}$ is determined in the control unit 3 based on the relationship of Equation (6), and applied to the ring electrode by the RF trap voltage power source 4.

A constant value obtained from an experiment or numerical analysis can be input in advance as the proportional constant C shown in Equation (3) and Equation (4), or the following analytical approximation equation shown by Equation (7) may be used.

$$C=2z_0\Omega\sqrt{\frac{E_{inj}}{e}} \quad \text{(where } X_0=0.5) \tag{7}$$

Figure 3:
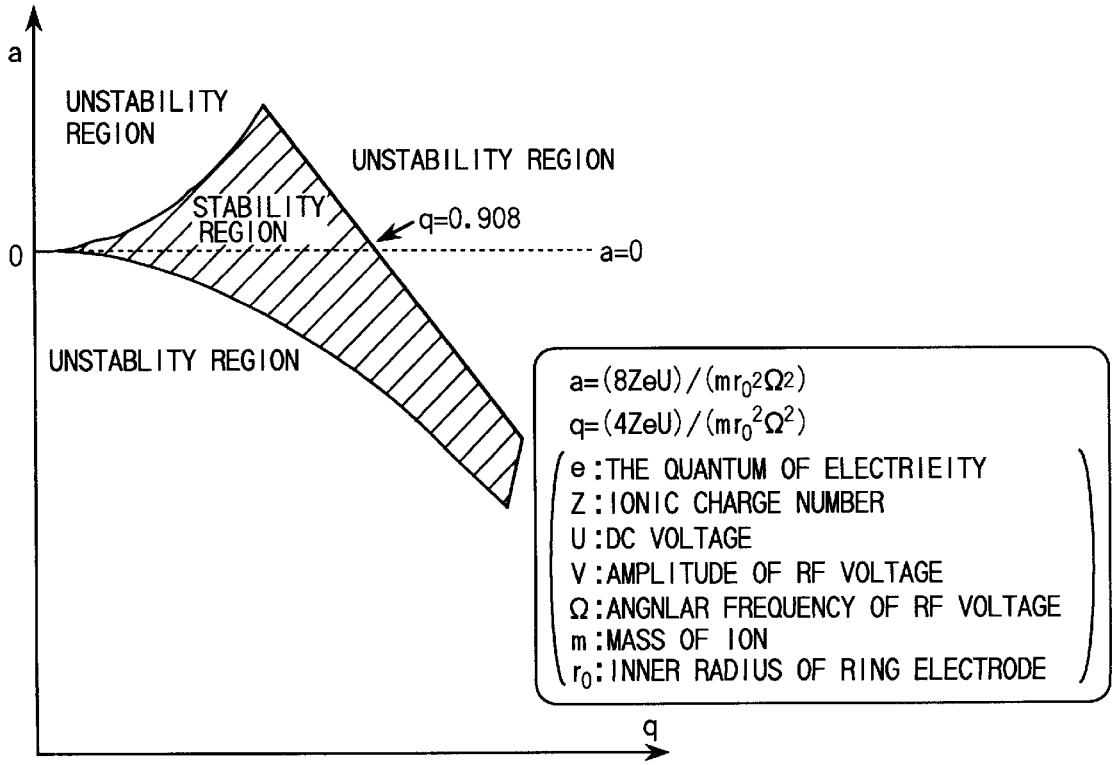
FIG. 3 is a stability diagram expressed by the range of the values a and b determining a stable oscillation of ions inside the ion trap volume.
Figure 4:
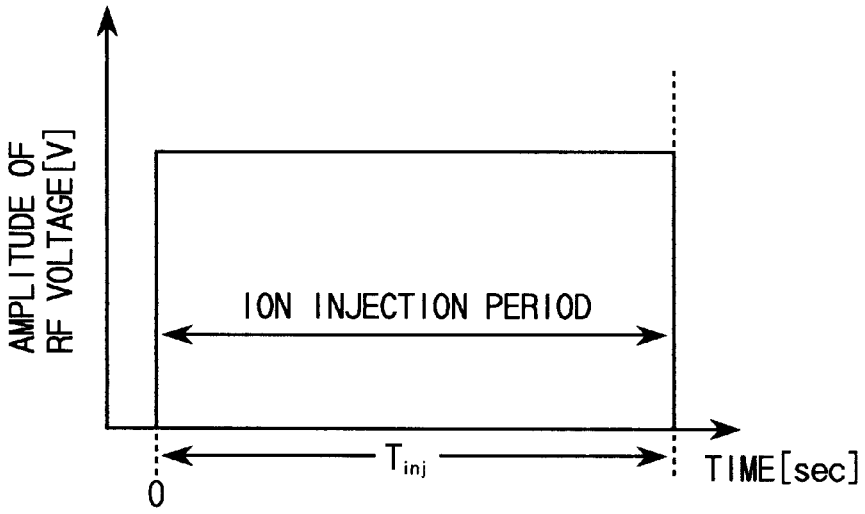
FIG. 4 is a diagram showing conventional amplitude of RF trap voltage versus time during an ion injection period in which ions are injected into an ion trap volume.
Figure 6:
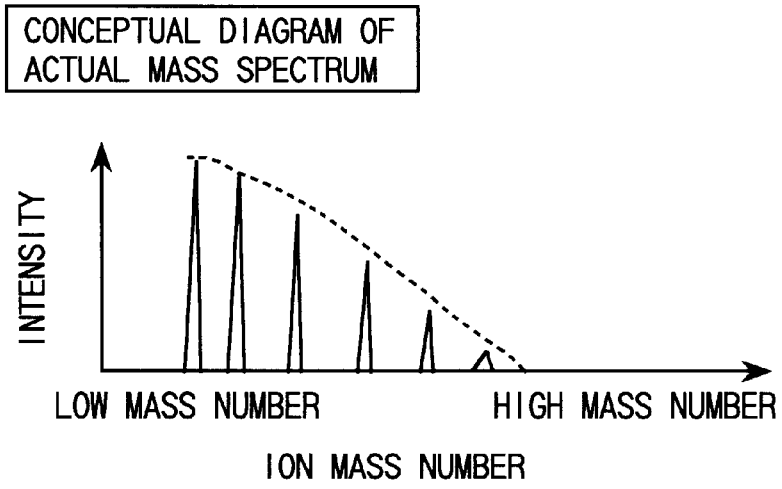
FIG. 6 is a conceptual diagram expressing a tendency of sensitivity change among different ion species in actually measured mass spectra.
Figure 12:
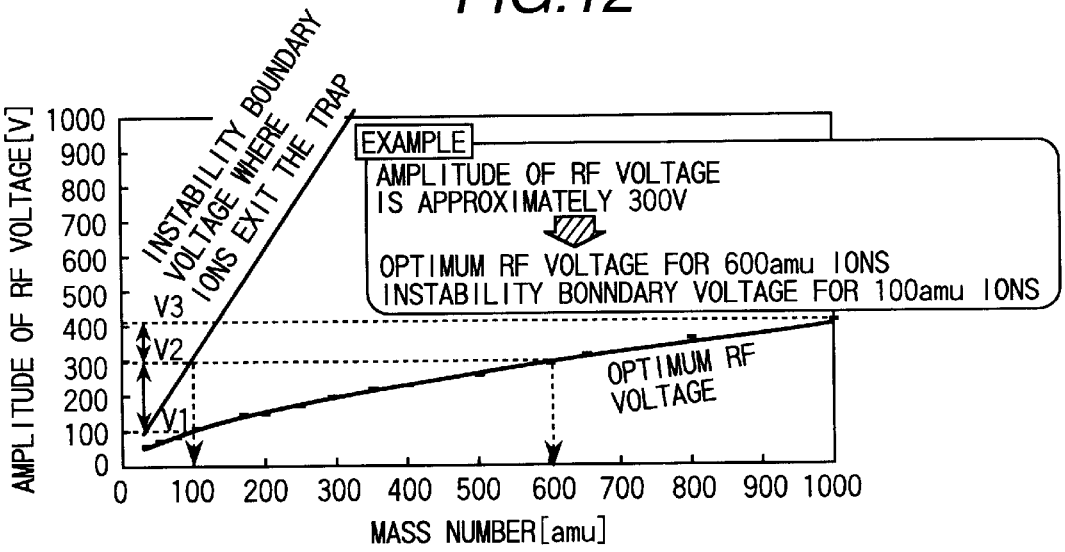
FIG. 12 is a diagram showing a relationship between an optimum trap voltage, at which the trapping efficiency becomes a maximum, and an ion mass number, and a relationship between an instability boundary voltage, where the q value becomes 0.908 and ions exit the ion trap, and an ion mass number.

As described above, when this embodiment is used, the trapping efficiency can be equally improved regardless of the ion species because the optimum trap voltage can be obtained to all the ions within the predetermined range of the mass-to-charge ratio during the ion injection period $T_{inj}$. However, because the magnitude of the amplitude of the RF trap voltage is a parameter to determine ion species to eject from the ion trap volume since q value of ions becomes out of the stability diagram shown in FIG. 3, particularly when ions within a wide range of the mass-to-charge ratio are injected, lower mass number ions are possibly ejected even if the RF trap voltage V is an optimum value for trapping higher mass number ions as shown in FIG. 12. For example, in a case where singly charged ions within the range of 100 amu to 1000 amu are injected starting from ions having a small mass number based on Equation (5), the trapping efficiency becomes maximum to the ions of 600 amu when the RF trap voltage is set to approximately 300 V. However, the ions of 100 amu which are already trapped before that time are ejected from the ion trap volume. An embodiment capable of avoiding such a problem will be described below.

Figure 13:
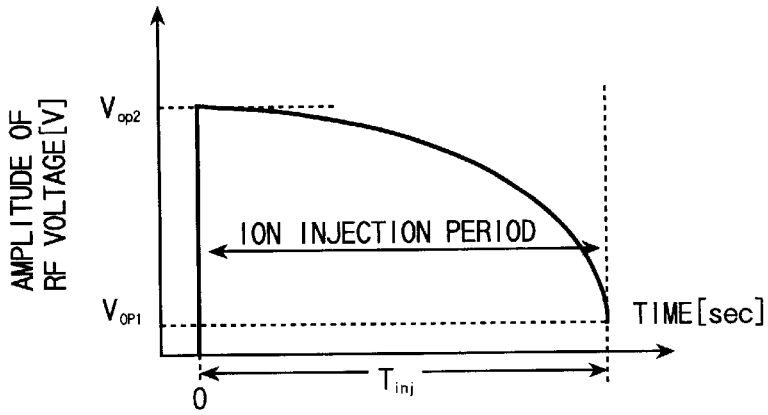
FIG. 13 is a diagram showing amplitude of RF trap voltage versus time in the second embodiment of a method of changing RF voltage during ion injection period in accordance with the present invention.

A second embodiment in accordance with the present invention will be described below, referring to FIG. 13. This embodiment is characterized by that when the RF trap voltage is set to the optimum trap voltage, the RF trap voltage is changed so that ion trapping is performed from the high mass number ions to the low mass number ions during the ion injection period $T_{inj}$. In a case where the predetermined range of the mass-to-charge ratio is m1 to m2 and the ions are assumed to be singly charged ions similar to the first embodiment, the range of the optimum trap voltage becomes $V_{op}1$ to $V_{op}2$ from the equation of the relationship between the mass-to-charge ratio and the optimum RF trap voltage $V_{op}$ of Equation (3) or Equation (4) (refer to Equation (4')).

Equation (8) shows the relationship between an objective ion species m when the RF trap voltage is set to an optimum trap voltage and time t during the ion injection period $T_{inj}$, and Equation (9) shows the relationship between an optimum trap voltage for all ions within the predetermined range of the mass-to-charge ratio and time t during the ion injection period. That is, as shown in FIG. 13, the amplitude of the RF trap voltage is decreased from $V_{op}2$ to $V_{op}1$ in this embodiment based on the Equation (9).

$$m = \frac{-m_2 + m_1}{T_{inj}} t + m_2 \quad (8)$$

$$V_{op} = C \cdot \left( \frac{-m_2 + m_1}{T_{inj}} t + m_1 \right)^{Xo} \quad (9)$$

($C$: proportional constant, $0 < Xo \leqq 1$)

In the case where the RF trap voltage is changed during the ion injection period as described above, even if the optimum trap voltage of the higher mass number ions becomes equal to the ejection voltage of the lower mass number ions as shown in FIG. 12, the RF trap voltage is not the optimum trap voltage for the lower mass number ions at that time. Therefore, the lower mass number ions are not trapped and not ejected. Then, the RF trap voltage becomes the optimum trap voltage of the lower mass number ions, and the lower mass number ions are trapped. Therefore, according to this embodiment, the trapping efficiency can be equally improved regardless of the ion species, and the ions once trapped are not ejected during the ion injection period, and all the ions having the mass-to-charge ratios within the predetermined range can be stably restrained, and accordingly high sensitive analysis can be expected to all the ion species.

Figure 8:
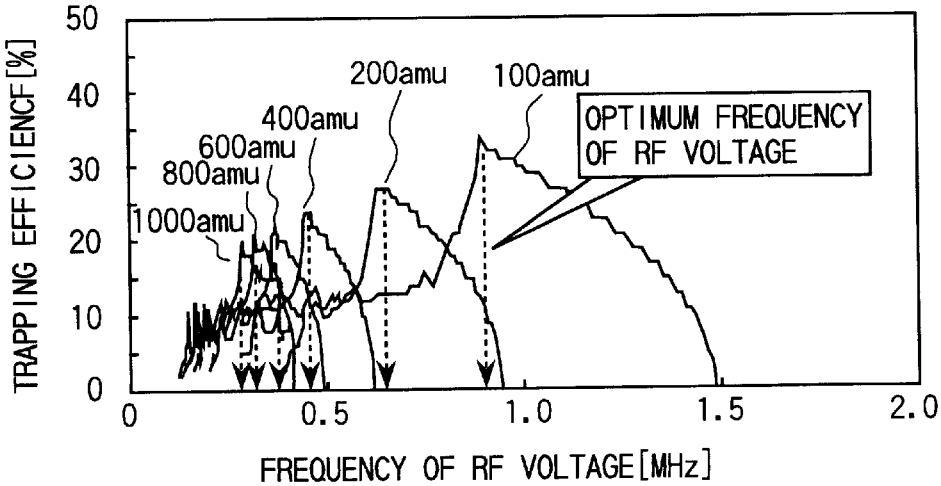
FIG. 8 is diagrams showing simulation results of trapping efficiencies for ions of 100 amu to 1000 amu when frequency of RF trap voltage is varied under conditions that amplitude of the RF trap voltage is set to a constant value and the ions are injected with a constant injection energy.
Figure 9:
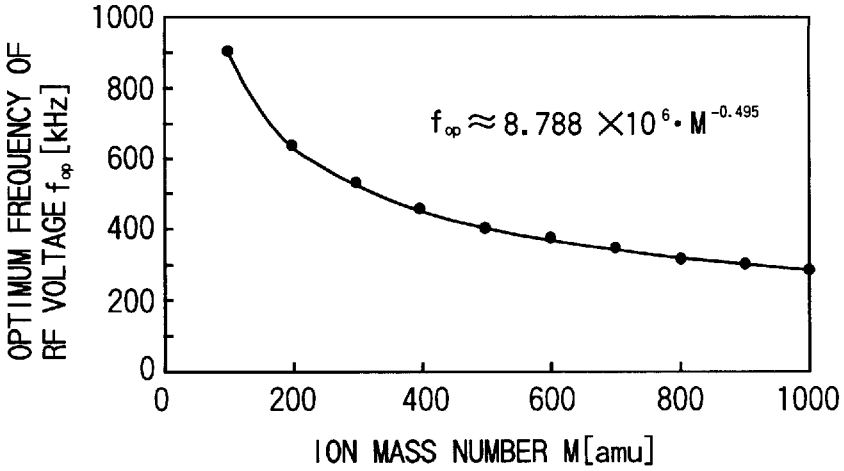
FIG. 9 is a diagram showing the relationship between the optimum trap voltage and ion mass number obtained from the simulation result of FIG. 8.
Figure 14:
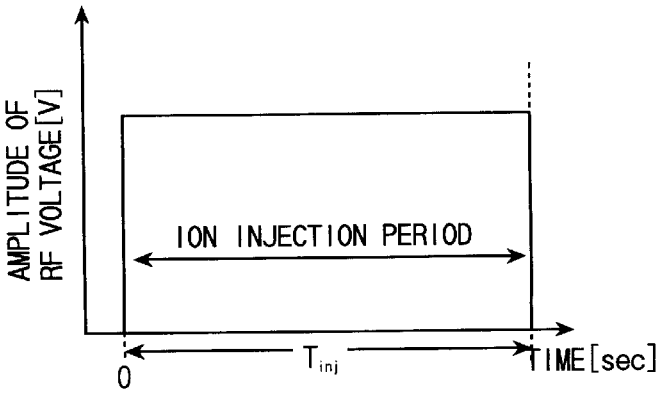
FIG. 14 is a diagram showing amplitude of RF trap voltage versus time in a third embodiment of a method of scanning RF trap voltage frequency during ion injection period in accordance with the present invention.

A third embodiment in accordance with the present invention will be described below, referring to FIG. 14, FIG. 15 and FIG. 16. In this embodiment, the amplitude of the RF trap voltage is set to constant during the ion injection period, and the frequency f ($=\Omega/2\pi$) of the RF trap voltage $V\cos(\Omega t)$ is changed. FIG. 8 shows a calculated result of the trapping efficiency by setting the amplitude of the RF trap voltage to 140 V and changing the frequency of the RF trap voltage during the ion injection period. It is obtained from numerical analysis that there exists a frequency giving the maximum trapping efficiency (optimum trap frequency) among the various frequencies of the RF trap voltage during the ion injection, and the optimum value is approximately in inverse proportion to 1/2 power of the mass-to-charge ratio of ions (FIG. 9). Equation (10) is an approximation equation expressing the relationship between mass-to-charge ratio and frequency $f_{op}$ of the optimum trap voltage obtained from the numerical analysis.

$$f_{op} = 8.788 \times 10^6 \cdot m^{-0.495} \quad (10)$$

Therein, this equation is valid for singly charged ions within 100 amu to 1000 amu and is calculated under assumption that the inner radius of the ring electrode $r_0$ is 1 cm, the amplitude V of the RF trap voltage is 140 V, the helium gas pressure $P_{He}$ is 1 motor, and the ion injection energy $E_n$ is 5 eV. A frequency range of the optimum trap voltage corresponding to all the ion species within the predetermined range of mass-to-charge ratio is obtained from this approximation equation, and the frequency of the RF trap voltage is gradually decreased within the range during the ion injection (trap) period. In general, the optimum trap frequency $f_{op}$ can be also expressed by the following approximation equation of power of mass-to-charge m/Z.

$$f_{op} = D \cdot (m/Z)^{-Yo} \quad (D\text{: proportional constant, } 0 < Yo \leqq 1) \quad (11)$$

In this case similar to the above, a frequency range of the optimum trap voltage corresponding to all the ion species within the predetermined range of mass-to-charge ratio is obtained from this approximation equation, and the frequency of the RF trap voltage is gradually decreased within the range during the ion injection period. The method of decreasing the frequency is as follows. In a case where the predetermined range of the mass-to-charge ratio is m1 to m2 and the ions are assumed to be singly charged ions similar to the first embodiment, the range of the optimum trap frequency becomes $f_{op}1$ to $f_{op}2$ from the equation of the relationship between the mass-to-charge ratio of ions and the optimum trap frequency $f_{op}$ of Equation (3) or Equation (4) (refer to Equation (11')).

$$f_{opi} = D \cdot m_i^{-Yo} \quad (i=1, 2) \quad (11')$$

In a case where an objective ion species m is changed in proportion to time t as shown by Equation (5) during ion injection time (trap period) $T_{inj}$ when the RF trap voltage applied to the ring electrode is set to the optimum trap frequency, the frequency f of the RF trap voltage is applied so as to satisfy the following equation (Equation (12)) with time t in order to always keep the frequency of the RF trap voltage within the optimum trap frequency for the ion species within the predetermined range.

$$f_{op} = D \cdot \left( \frac{m_2 - m_1}{T_{inj}} t + m_1 \right)^{Yo} \quad (12)$$

($D$: proportional constant, $0 < Yo \leqq 1$)

Figure 15:
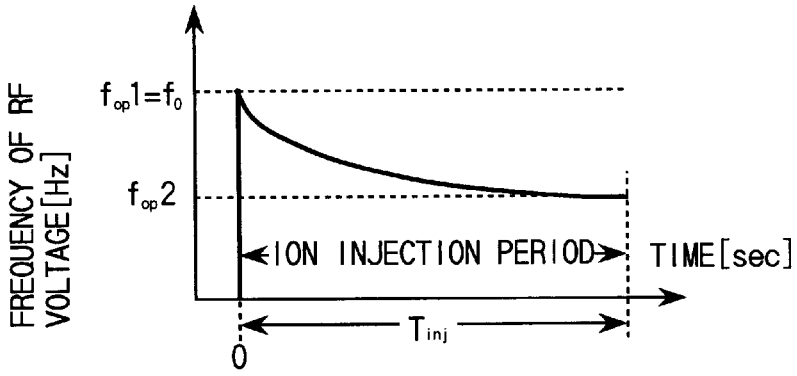
FIG. 15 is a diagram showing frequency of RF trap voltage versus time in the third embodiment of a method of changing RF trap voltage during ion injection period in accordance with the present invention.
Figure 16:
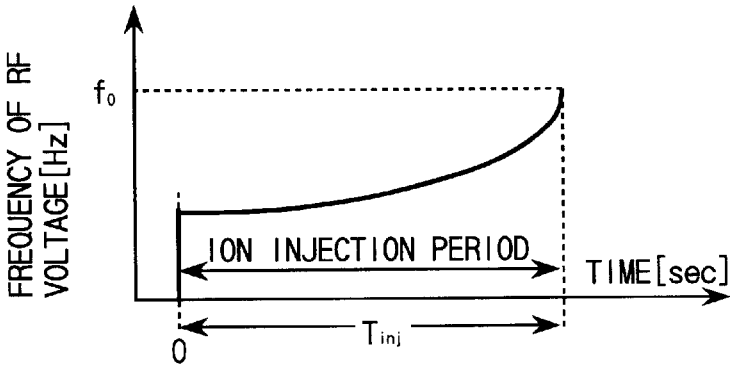
FIG. 16 is a diagram showing frequency of RF trap voltage versus time in the third embodiment of a method of changing RF trap voltage during ion injection period in accordance with the present invention.

FIG. 15 shows the method of applying the frequency of the RF trap voltage during the ion injection period based on the above correlation equation. On the other hand, similar to the conventional method, the amplitude of the RF trap voltage V during the ion injection period $T_{inj}$ is kept at a constant value. The frequency f of the RF trap voltage during the ion injection period $T_{inj}$ is determined in the control unit 3 based on the relationship of Equation (12), and applied to the ring electrode by the RF trap voltage power source 4.

A constant value obtained from an experiment or numerical analysis can be input in advance as the proportional constant D shown in Equation (11) and Equation (12), or the following analytical approximation equation shown by Equation (13) may be used.

$$D = \frac{V}{4\pi z_0} \sqrt{\frac{e}{E_{inj}}} \quad (\text{where } Y_0 = 0.5) \quad (13)$$

In this embodiment, the RF trap voltage applied to the ring electrode may be changed so that the optimum trap frequency for objective ion species m is changed from the high mass number ions to the low mass number ions during the ion injection period $T_{inj}$ as shown by Equation (9), similarly to the second embodiment. The frequency f of the RF trap voltage is applied so as to satisfy the following correlation equation (Equation (14)) with time t. FIG. 16 shows the method of applying the frequency of the RF trap voltage during the ion injection period based on the above correlation equation.

$$f_{op} = D \cdot \left( \frac{-m_2 + m_1}{T_{inj}} t + m_2 \right)^{Yo} \quad (14)$$

($D$: proportional constant, $0 < Yo \leqq 1$)

As described above, when this embodiment is used, the trapping efficiency can be equally improved regardless of the ion species because the optimum trap frequency can be obtained to all the ions within the predetermined range of the mass-to-charge ratio during the ion injection period. Therefore, instead of changing the amplitude of the RF trap voltage, it is expected that the same effect can be obtained by changing the frequency of the RF trap voltage.

A fourth embodiment in accordance with the present invention will be described below, referring to FIG. 17 and FIG. 18, FIG. 19 and FIG. 20, FIG. 21 and FIG. 22 FIG. 23 and FIG. 24. In this embodiment, the correlation equations (Equations (3), (4), (6), (9), (10), (11), (12) and (14)) shown in the first to the third embodiments are not directly used when the amplitude or the frequency of the RF trap voltage is changed during the ion injection period, but the amplitude or the frequency of the RF trap voltage is changed using a correlation in proportion to time. For example, in a case where the frequency of the RF trap voltage is kept constant and the amplitude of the RF trap voltage is changed during the ion injection period, when the predetermined range of the mass-to-charge ratio is m1 to m2 and the ions are assumed to be singly charged ions, the range of the optimum trap voltage becomes $V_{op}1$ to $V_{op}2$ from the equation of the relationship between the mass-to-charge ratio of ions and the optimum trap voltage $V_{op}$ of Equation (3) or Equation (4) (refer to Equation (4')).

Figure 17:
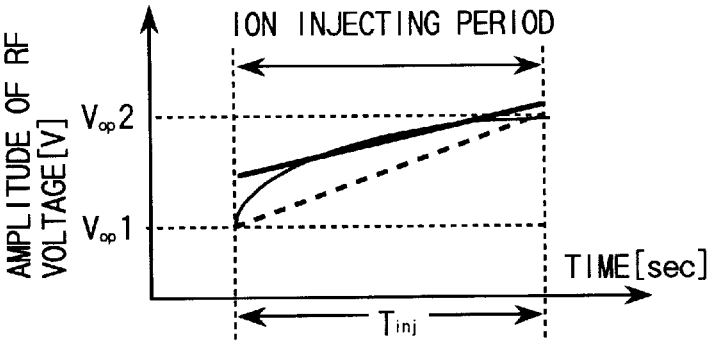
FIG. 17 and FIG. 18 are diagrams showing amplitude of RF trap voltage versus time in a fourth embodiment of a method of changing RF trap voltage during ion injection period in accordance with the present invention.

Therein, the RF trap voltage V may be changed based on a correlation equation in proportion to time t of the first degree such as Equation (15). FIG. 17 shows the change in the amplitude of the RF trap voltage in such a case.

$$V_{op} = \frac{V_{op2} - V_{op1}}{T_{inj}} t + V_{op1} \tag{15}$$

Further, a range of mass-to-charge ratio for an ion species particularly required to be trapped is selected out of the predetermined range of mass-to-charge ratio, and a gradient and an intercept of an RF trap voltage to time is calculated so as to approach to the RF trap voltage based on the correlation equation between the mass-to-charge ratio and the optimum trap voltage $V_{op}$ of Equation (3) or Equation (4) in the selected range. Then the amplitude of the RF trap voltage is controlled based on the correlation in proportion to time such as Equation (15). The change in the amplitude of the RF trap voltage in that case is shown in FIG. 17 by a bold line. The line shows a case where an ion species having a large mass-to-charge ratio is selected out of the predetermined range.

Figure 18:
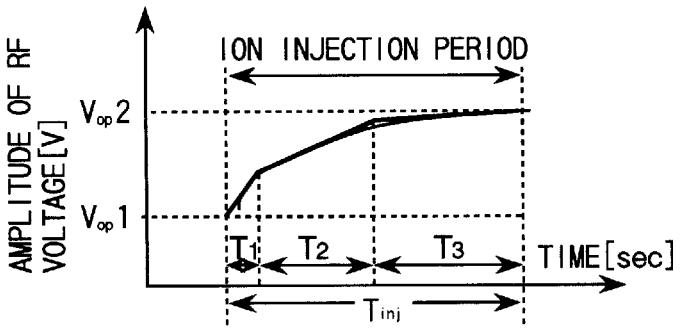
Figure 19:
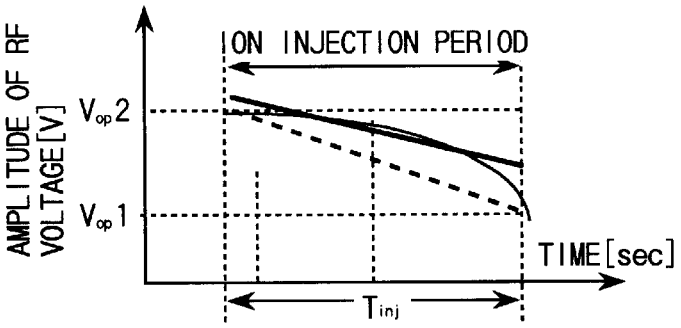
FIG. 19 and FIG. 20 are diagrams showing amplitude of RF trap voltage versus time in the fourth embodiment of a method of changing RF trap voltage during ion injection period in accordance with the present invention.
Figure 20:
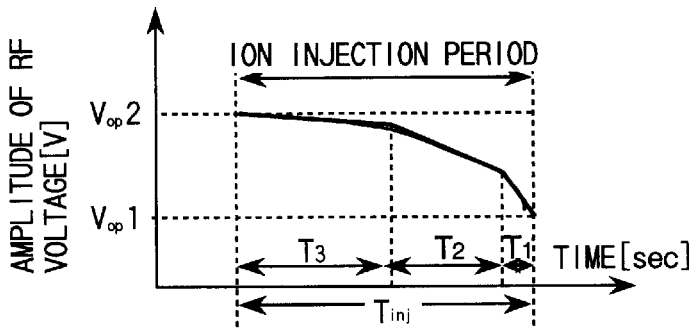
Figure 21:
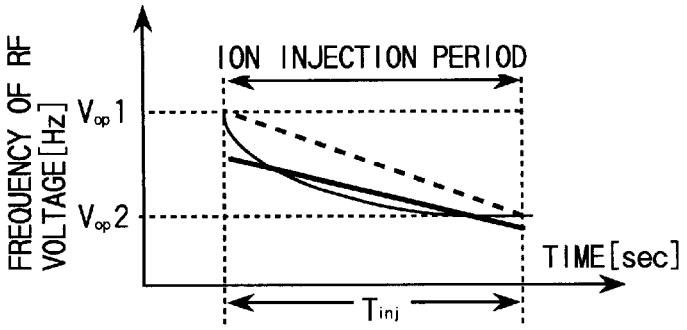
FIG. 21 and FIG. 22 are diagrams showing frequency of RF trap voltage versus time in the fourth embodiment of a method of changing RF trap frequency during ion injection period in accordance with the present invention.
Figure 22:
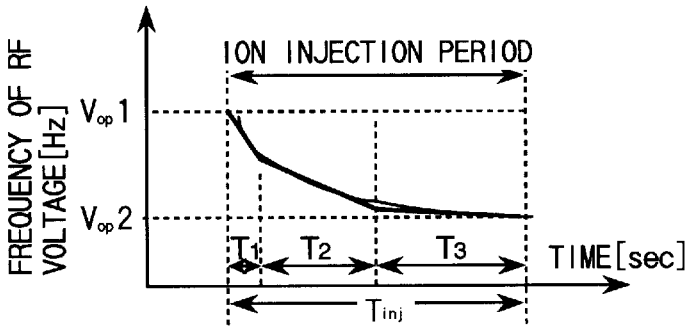

It is also possible that the ion injection period $T_{inj}$ is divided into a plurality of ranges, and a linear equation of RF trap voltage to time for each of the divided ranges (a gradient and an intercept) is calculated as shown in FIG. 18, and then the amplitude of the RF trap voltage is controlled based on the correlation equations. Therein, it is preferable that the linear equation (the gradient and the intercept) for each of the divided ranges is calculated so as to approach to the change in the correlation equation between the mass-to-charge ratio and the optimum trap voltage $V_{op}$ of Equation (3) or Equation (4).

Figure 23:
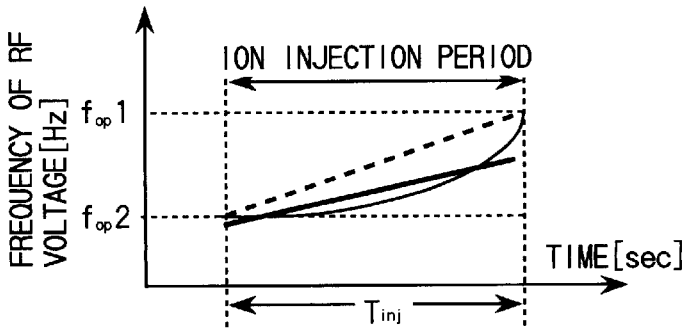
FIG. 23 and FIG. 24 are diagrams showing frequency of RF trap voltage versus time in the fourth embodiment of a method of changing RF trap frequency during ion injection period in accordance with the present invention.
Figure 24:
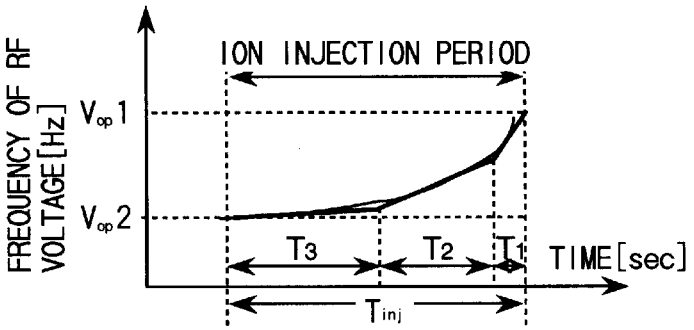

The method of changing the RF trap voltage during the ion injection period shown in FIG. 17 and FIG. 18 can be easily applied to a case where the RF trap voltage is decreased during the ion injection period (FIG. 19 and FIG. 20), a case where the frequency of the RF trap voltage is decreased during the ion injection period (FIG. 21 and FIG. 22) and a case where the frequency of the RF trap voltage is increased during the ion injection period (FIG. 23 and FIG. 24).

Therefore, by using the correlation equations shown in FIG. 17 and FIG. 18, FIG. 19 and FIG. 20, FIG. 23 and FIG. 24, it is easy to perform control of the RF tap voltage during the ion injection period for equally improving the trapping efficiency regardless of the ion species.

A fifth embodiment in accordance with the present invention will be described below, referring to FIG. 25 to FIG. 28. In this embodiment, when the amplitude or the frequency of the RF trap voltage is changed during the ion injection period, the change is performed in a step-shape. For example, in a case where the frequency of the RF trap voltage is kept constant during the ion injection period and the amplitude of the RF trap voltage is increased, the ion injection period is divided into a plurality of ranges, and the RF trap voltage is set to a constant value within each of the divided ranges, and the constant value is increased range-by-range. Therein, it is preferable that the constant value for each of the divided ranges is determined from the correlation equation between the mass-to-charge ratio and the optimum trap voltage $V_{op}$ of Equation (3) or Equation (4) so that the value of the RF trap voltage approaches to the optimum trap voltage change. According to this embodiment, it is easy to change the RF tap voltage during the ion injection period and to equally improve the trapping efficiency regardless of the ion species.

Figure 28:
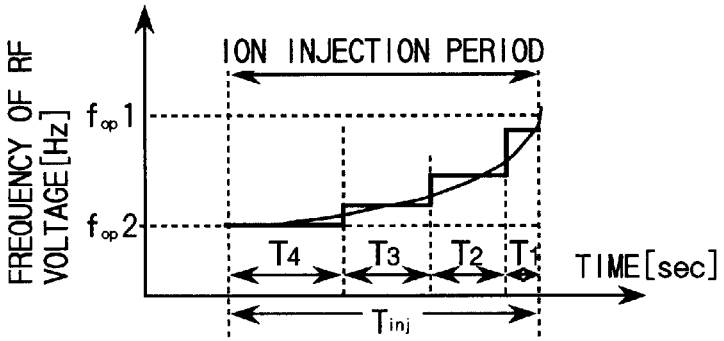

The method of changing the RF trap voltage in the step-shape during the ion injection period can be easily applied to a case where the RF trap voltage is decreased during the ion injection period (FIG. 26), a case where the frequency of the RF trap voltage is decreased during the ion injection period (FIG. 27) and a case where the frequency of the RF trap voltage is increased during the ion injection period (FIG. 28).

Figure 29:
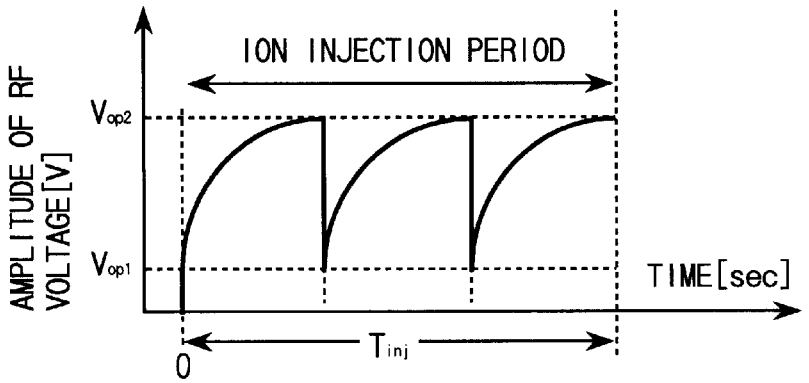
FIG. 29 and FIG. 30 are diagrams showing amplitude of RF trap voltage versus time in a sixth embodiment of a method of changing RF trap voltage during ion injection period in accordance with the present invention.
Figure 30:
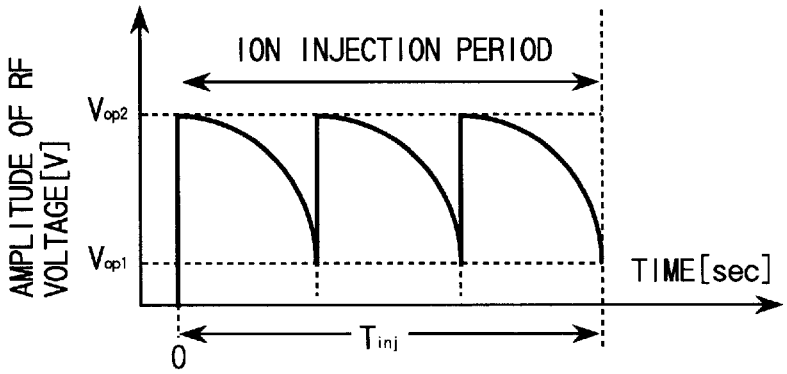

A sixth embodiment in accordance with the present invention will be described below, referring to FIG. 29 to FIG. 32. In this embodiment, the ion injection period is divided into a plurality of ranges, and in each of the divided ranges the amplitude of the RF trap voltage or the frequency of the RF trap voltage is changed within the optimum range, and the change is repeated by the dividing number times. For example, in a case where the frequency of the RF trap voltage is kept constant during the ion injection period and the amplitude of the RF trap voltage is increased, FIG. 29 shows the feature of repeating the increase of the amplitude of the RF trap voltage during the ion injection period within the optimum range $V_{op}1$ to $V_{op}2$ (refer to Equation (4')) in the case of the predetermined range m1 to m2 of the mass-to-charge ratio. For example, in a case where a liquid chromatography is connected before the ion trap, there is a time lag in injection timing of ions into the ion trap depending on an ion species. Therefore, the RF trap voltage possibly becomes the optimum trap voltage for the ion species before the ion species may be injected into the ion trap. Accordingly, if the optimum trap voltage is scanned only once, there is possibility that some ion species miss their optimum timing for being injected into the ion trap and cannot be trapped depending on the ion species.

According to this embodiment, since scanning of the amplitude of the RF trap voltage within the optimum trap voltage range is repeated many times during the ion injection period, the trapping efficiency can be equally improved regardless of the ion species even if there is a time lag in injection timing of ions into the ion trap depending on an ion species.

Figure 25:
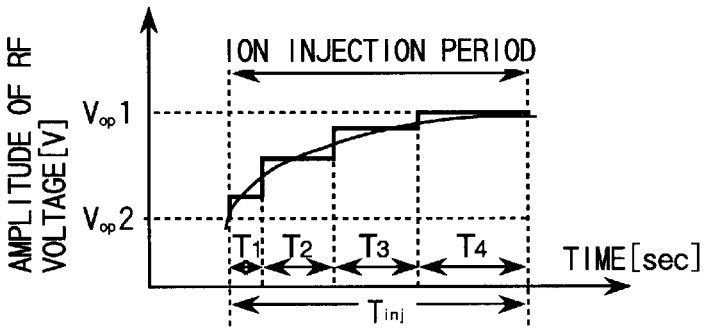
FIG. 25 and FIG. 26 are diagrams showing amplitude of RF trap voltage versus time in a fifth embodiment of a method of changing RF trap voltage during ion injection period in accordance with the present invention.
Figure 26:
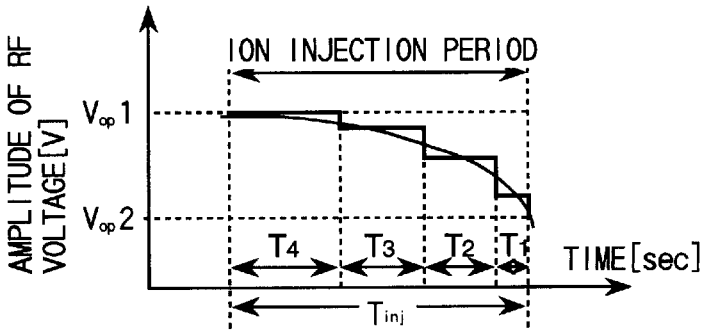
Figure 27:
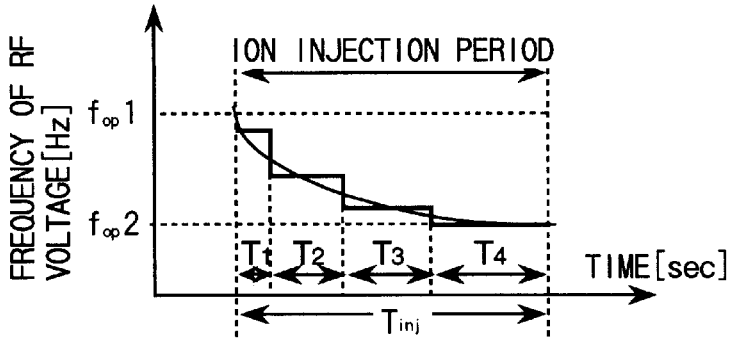
FIG. 27 and FIG. 28 are diagrams showing frequency of RF trap voltage versus time in the fifth embodiment of a method of changing RF trap voltage during ion injection period in accordance with the present invention.

The method of increasing the RF trap voltage in FIG. 29 is based on the correlation equation between the mass-to-charge ratio and the optimum trap voltage $V_{op}$ of Equation (3) or Equation (4), but the method of increasing the RF trap voltage shown in FIG. 17 or FIG. 25 may be employed.

Figure 31:
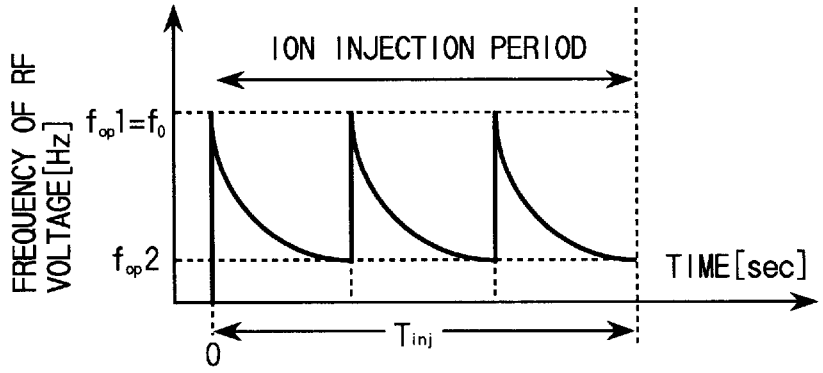
FIG. 31 and FIG. 32 are diagrams showing frequency of RF trap voltage versus time in the sixth embodiment of a method of changing RF trap frequency during ion injection period in accordance with the present invention.
Figure 32:
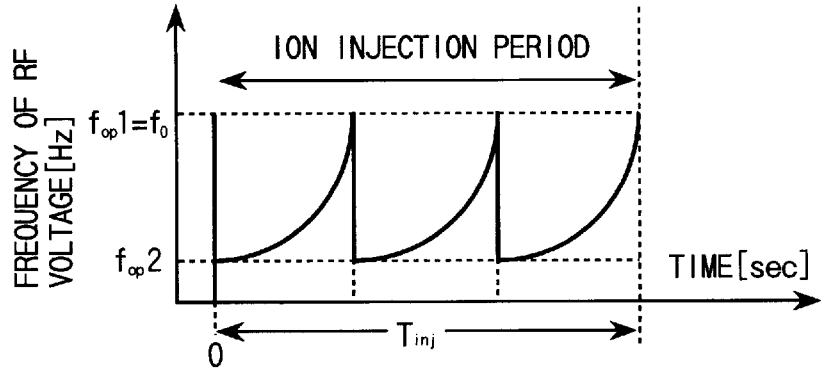

The method of changing the RF trap voltage as described above during the ion injection period can be easily applied to a case where the amplitude of the RF trap voltage is decreased during the ion injection period, a case where the frequency of the RF trap voltage is decreased during the ion injection period and a case where the frequency of the RF trap voltage is increased during the ion injection period, as shown in FIG. 31 to FIG. 32.

Figure 33:
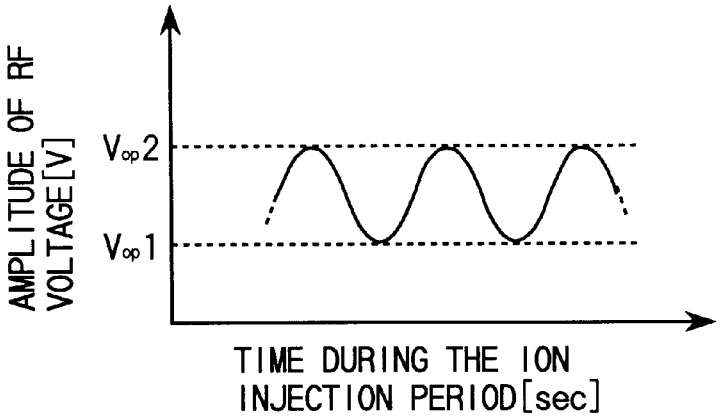
FIG. 33 is a diagram showing amplitude of RF trap voltage versus time in a seventh embodiment of a method of changing RF trap voltage during ion injection period in accordance with the present invention.
Figure 34:
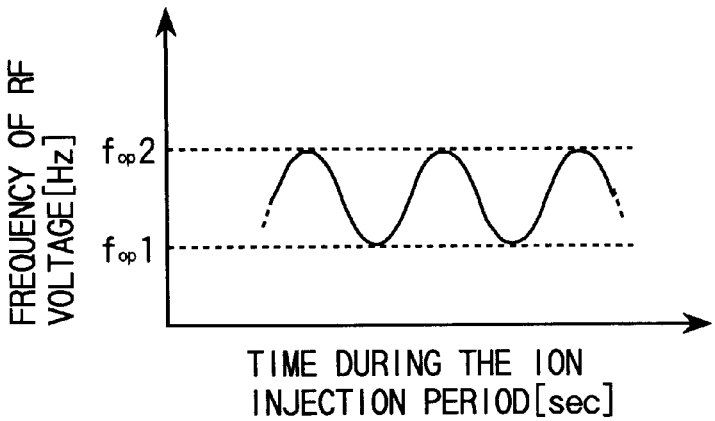
FIG. 34 is a diagram showing frequency of RF trap voltage frequency versus time in a seventh embodiment of a method of changing RF trap voltage frequency during ion injection period in accordance with the present invention.

A seventh embodiment in accordance with the present invention will be described below, referring to FIG. 33 to FIG. 34. In this embodiment, a trigonometric function wave as shown in FIG. 33 and FIG. 34 may be employed for the method of repeating to increase and decrease the amplitude of the RF trap voltage or the frequency of the RF trap voltage during the ion injection period. According to this embodiment, it becomes very easy to control increasing and decreasing the amplitude of the RF trap voltage or the frequency of the RF trap voltage during the ion injection period.

Figure 35:
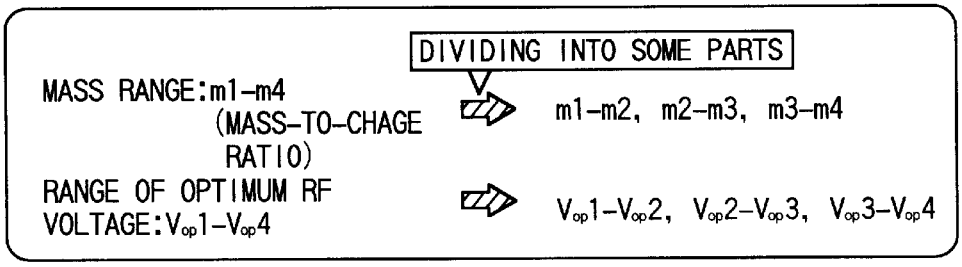
FIG. 35 is a conceptual diagram showing an eighth embodiment of a method of separating ion injection period before mass analysis in accordance with the present invention.

An eighth embodiment in accordance with the present invention will be described below, referring to FIG. 35 to FIG. 36. In this embodiment, the predetermined range of the mass-to-charge ratio is divided into a plurality of ranges, and the ion injection and the mass separation are performed for each of the divided range of the mass-to-charge ratio. However, as shown in FIG. 35, a range of an optimum trap voltage corresponding to ions within each of the divided ranges of the mass-to-charge ratio is calculated. And the RF trap voltage during the ion injection period is determined based on the calculated result. For example, when the predetermined range of the mass-to-charge ratio m1 to m4 is divided into three ranges of m1–m2, m2–m3 and m3–m4 as shown in FIG. 35, the mass separation process is constructed by allocating a mass separation period B1 after an ion injection period A1; allocating a mass separation period B2 after an ion injection period A2; and then allocating a mass separation period B3 after an ion injection period A3, as shown in FIG. 36.

Figure 36:
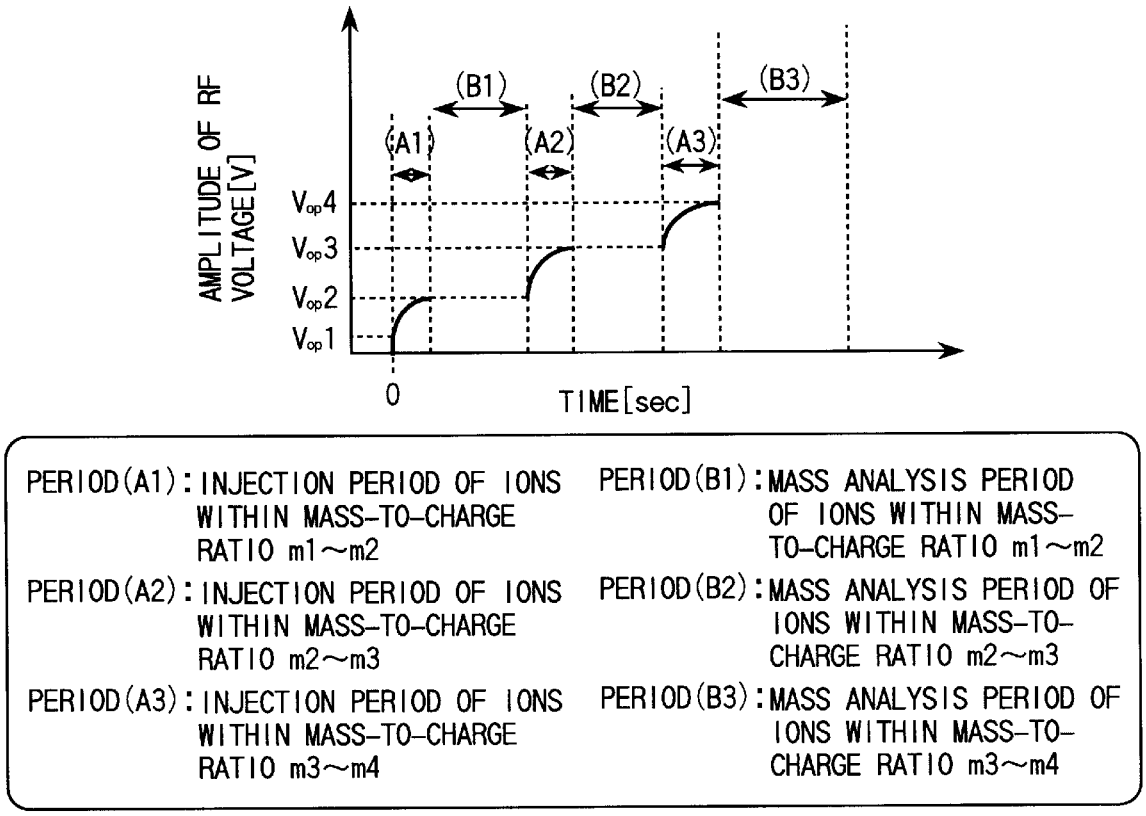
FIG. 36 is a diagram showing RF trap voltage versus time in the eighth embodiment of the method of changing RF trap voltage in accordance with the present invention that the ion injection period is separated, ion injection and ion separating time are provided within each of the separated mass ranges, and the RF trap voltage is changed during each ion injection period before mass analysis within each mass range.

In FIG. 36, the amplitude of the RF trap voltage is increased as $V_{op}1-V_{op}2$, $V_{op}2-V_{op}3$, $V_{op}3-V_{op}4$ in the ion injection periods A1, A2 and A3 of the divided ranges of the mass-to-charge ratio, respectively. The amplitude of RF trap voltage may be decreased as $V_{op}2-V_{op}1$, $V_{op}3-V_{op}2$, $V_{op}4-V_{op}3$ in the ion injection periods A1, A2 and A3 of the divided ranges of the mass-to-charge ratio, respectively. Further, the frequency of the RF trap voltage may be changed in the ion injection periods A1, A2 and A3 of the divided ranges of the mass-to-charge ratio instead of the amplitude of the RF trap voltage.

Figure 5:
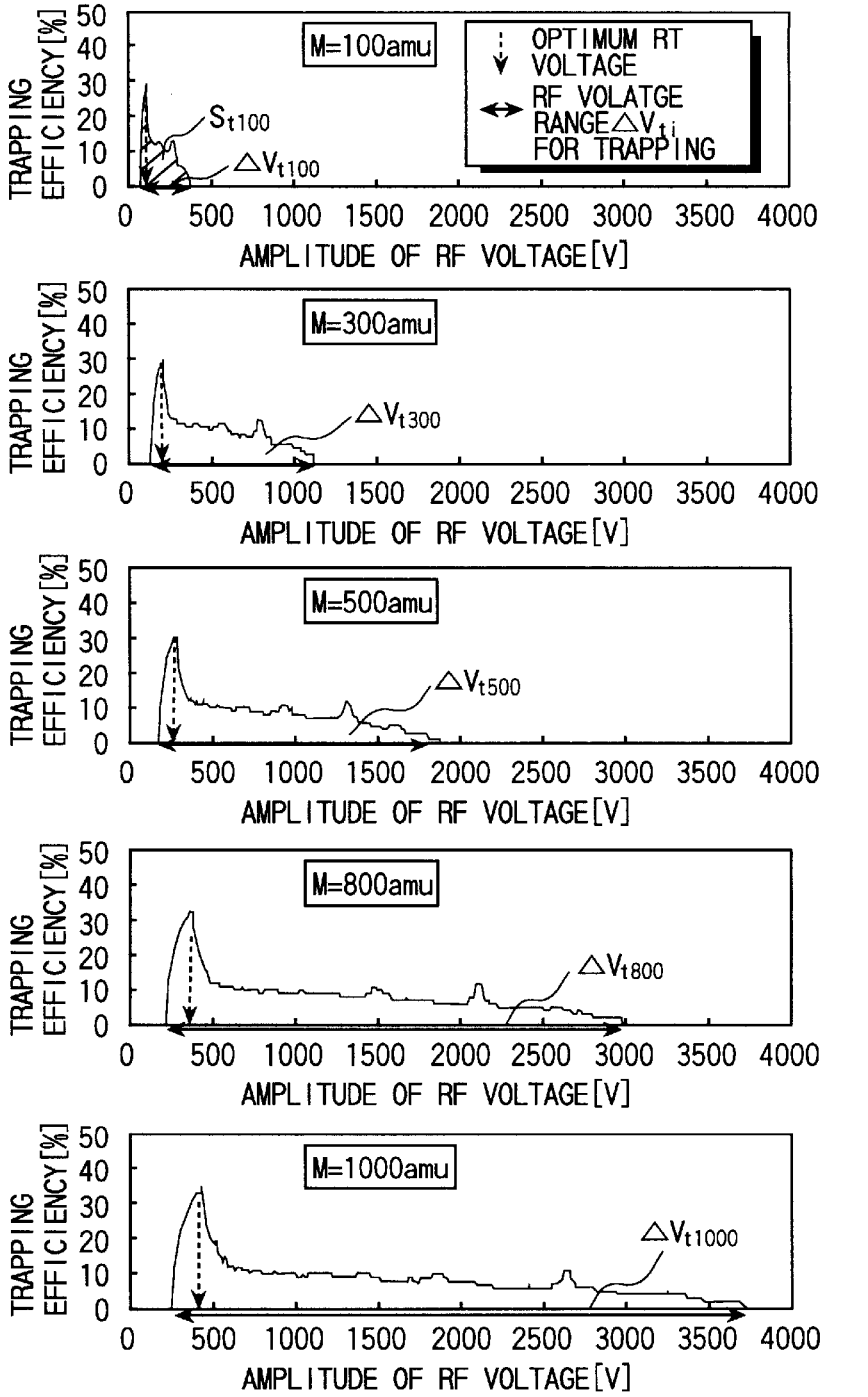
FIG. 5 is diagrams showing analytical results of trapping efficiency for ions of 100 amu to 1000 amu when amplitude of RF trap voltage is varied under conditions that frequency of the RF trap voltage is set to a constant value and the ions are injected with a constant injection energy.
Figure 37:
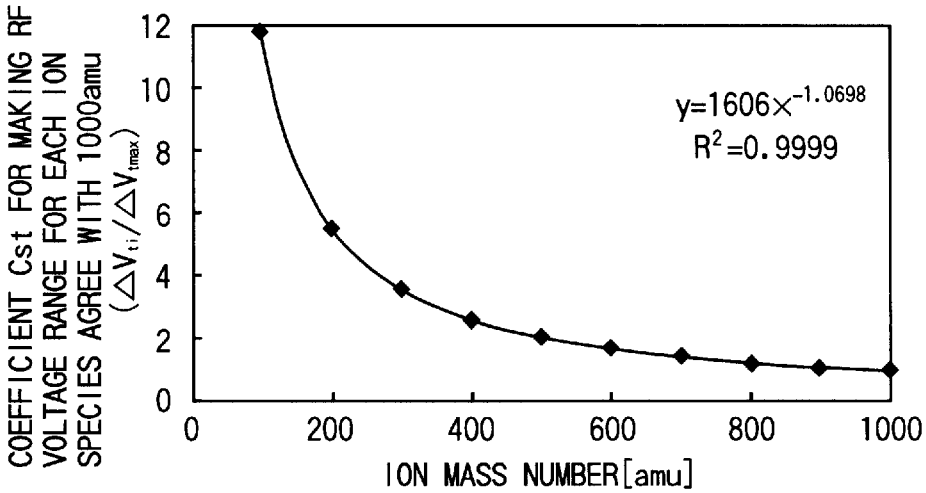
FIG. 37 is a diagram showing ratio of trap voltage range for each ion species to that of the maximum mass number ion in the mass range to be mass analyzed obtained based on the result of FIG. 5.

A ninth embodiment in accordance with the present invention will be described below, referring to FIG. 5 and FIG. 37 to FIG. 40. From FIG. 5 showing the simulation results of trapping efficiency of each ion species when the amplitude of the RF is changed and the frequency of the RF trap voltage is kept constant, it can be understood that the range of the RF trap voltage capable of trapping ions differs depending on the ion species. Since a sensitivity for each ion species can be considered to be expressed by an integrated value $S_{tm}$ (FIG. 5) of the trapping efficiency within the trap voltage range in FIG. 5, it is expected that the sensitivity is largely different depending on the ion species when the RF trap voltage is linearly changed with time within a certain range during the ion injection period. Therefore, a range of the RF trap voltage (trap voltage range $\Delta V_{ti}$ as shown in FIG. 5) capable of each of ion species within a mass number range $M_1$ to $M_{max}$ of ions which is intended to be trapped is calculated, and a coefficient $C_{st}$ (=($\Delta V_{tmax}$ for maximum mass number ion)/($\Delta V_{ti}$ for each ion species)) for making the trap voltage range $\Delta V_{ti}$ for each of the ion species agree with the trap voltage range $\Delta V_{tmax}$ for maximum mass number ion is calculated. The results are shown in FIG. 37. In this calculation, the maximum ion mass number is set to 1000 amu. Since the trap voltage range $\Delta V_{ti}$ is smaller and accordingly the coefficient $C_{st}$ becomes larger as the ion mass number becomes smaller, it can be understood that the coefficient $C_{st}$ and the ion mass number are in an inverse proportional relationship.

Figure 38:
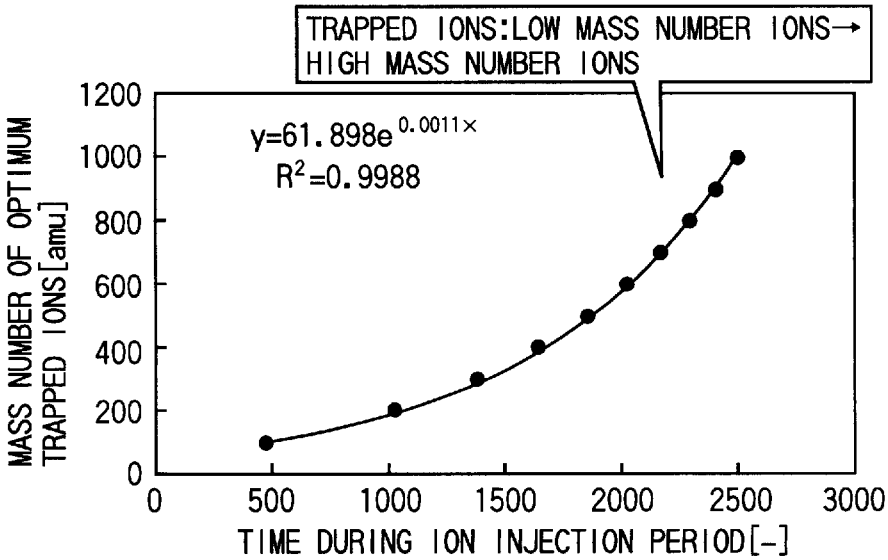
FIG. 38 is a diagram showing a ninth embodiment of a method of changing RF trap voltage versus time during the ion injection period in accordance with the present invention when the optimum trap voltage is changed from a low mass number ion to a high mass number ion.
Figure 39:
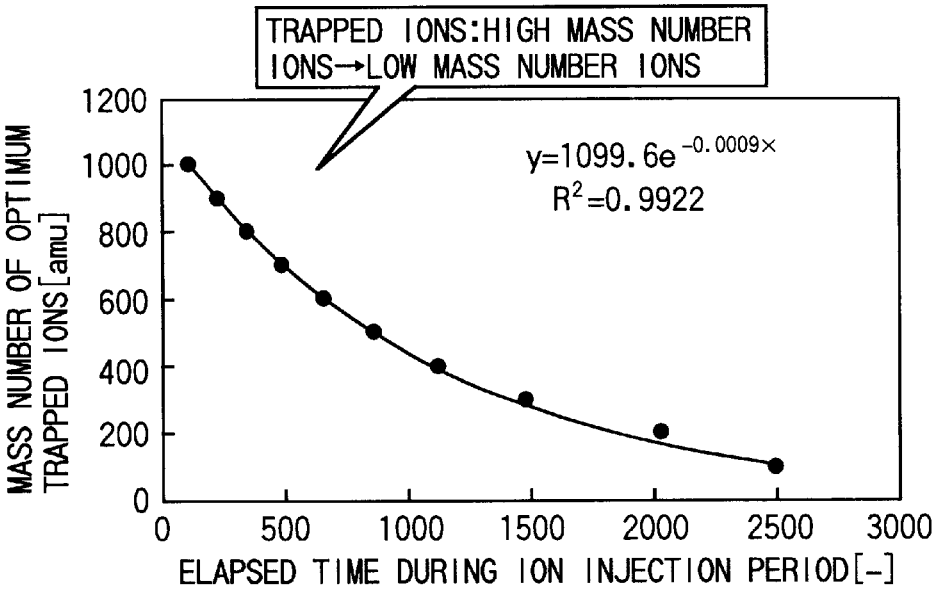
FIG. 39 is a diagram showing the ninth embodiment of a method of changing RF trap voltage versus elapsed time during the injection period in accordance with the present invention when the optimum trap voltage is changed from a high mass number ion to a low mass number ion.

This embodiment is characterized by that the RF trap voltage is changed with time during the injection period using this relationship. In this embodiment, in order that the RF trap voltage is scanned over the range of optimum trap voltages for the respective ion species while the ions are being injected and trapped between the trap electrodes, the RF trap voltage is changed as follows. The RF trap voltage is scanned so that for an allocated period (optimum trap period) $T_{max}$ set to an optimum trap voltage for the maximum mass number ion within the mass number range $M_1$ to $M_{max}$ of ions which is intended to be trapped, an optimum period $T_i$ for an ion $M_i$ becomes $C_{st}$ times as large as $T_{max}$. That is, for a low mass number ion having a small $S_t$ value corresponding to its sensitivity, the RF trap voltage is slowly scanned around its optimum trap voltage. By doing so, the trapping efficiency for the low mass number ions can be increased equally to the trapping efficiency for the high mass number ions. The relationship actually changing the RF trap voltage to the optimum trap voltages for various ion species with time is shown in FIG. 38 and FIG. 39. Therein, FIG. 38 shows the result obtained by integrating the relationship of FIG. 37 from the low mass number ion to the high mass number ion so that the RF trap voltage becomes the optimum trap voltage. On the other hand, FIG. 39 shows the result obtained by integrating the relationship of FIG. 37 from the high mass number ion to the low mass number ion so that the RF trap voltage becomes the optimum trap voltage. There, the values are calculated under assumption that the maximum mass number ion is set to 1000 amu, and the optimum trap period set for the 1000 amu ions' trap voltage is 1 (one, non-dimensional number). That is, only by setting the optimum trap period $T_{max}$ for the maximum mass number ion, the optimum method of changing the RF trap voltage can be obtained by multiplying the relationship of FIG. 38 or FIG. 39 by $T_{max}$.

Figure 40:
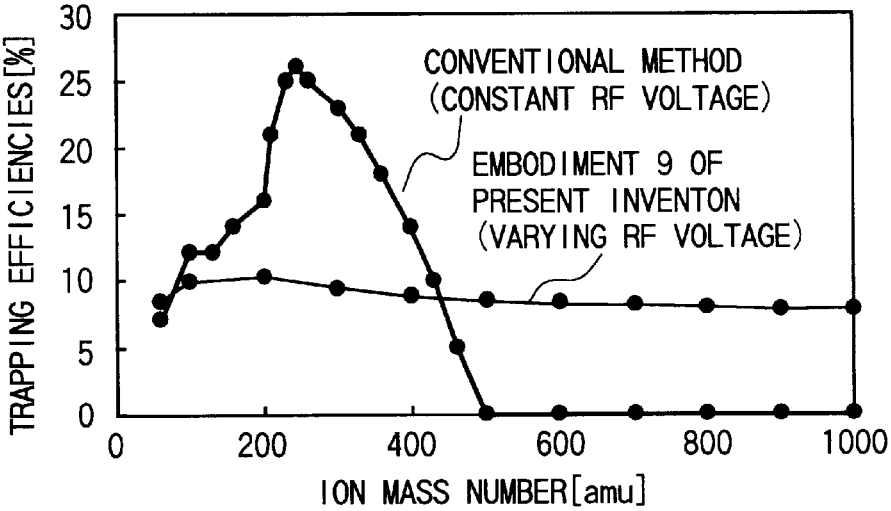
FIG. 40 is a diagram showing a numerical analysis results of trapping efficiencies for each ion species in a case of employing the ninth embodiment of the method of changing RF trap voltage during the injection period in accordance with the present invention.

FIG. 40 shows difference in the trapping efficiency for each ion species obtained from numerical analysis in a case of employing the method described above and a case of setting the RF trap voltage to a constant value during the ion injection period as in the conventional method. In the case of employing the conventional method, it can be understood that unequal trapping efficiencies are obtained, and particularly there exists a range where ions are little trapped. On the other hand, in the case of employing the scanning method of the present embodiment, it can be understood that it is possible to trap ions in the range where ions are not trapped by the conventional method, and the trapping efficiency for each ions is substantially uniform.

As described above, according to the embodiments of the present invention, ions are certainly trapped and mass separated regardless of the mass-to-charge ratio even when the range of mass-to-charge ratio to be mass separated is wide. Further, it is possible to avoid ejection of low mass ions due to change in the RF trap voltage during the ion injection period by dividing the range of mass-to-charge ratio to be mass separated or by scanning the optimum RF trap voltage for ions from the higher mass number to the lower mass number during the ion injection period. Furthermore, the trapping efficiencies for each ions can be made uniform.

According to the present invention, it is possible to provide an ion-trap mass spectrometer performing mass analysis by injecting ions generated outside an ion trap mass spectrometer into the ion trap volume between the ring and end-cap electrodes and trapping the ions, which prevents the trapping efficiency of ions from largely depending on the mass-to-charge ratio, and thereby, is suitable for obtaining a high sensitive mass spectrum, substantially independently of ion species.

What is claimed is:

1. An ion trap mass spectrometer comprising:

a rind electrode;

end cap electrodes arranged opposite to each other so that said ring electrode is interposed between the end cap electrodes;

a radio frequency power source for generating a radio frequency voltage applied to said ring electrode and said end cap electrodes so as to form a radio frequency electric field in an ion trap volume formed between said ring electrode and said end cap electrodes; and means for generating ions and injecting the ions into said ion trap volume during a predetermined period, the ions being injected into and trapped in said ion trap volume, the trapped ions being ejected from said ion trap volume, wherein said radio frequency electric field is successively changed in frequency during said predetermined ion injection period.

2. An ion trap spectrometer according to claim 1, wherein said frequency is changed so as to be increased or decreased with time.

3. An ion trap mass spectrometer according to claim 1, wherein said frequency is changed so as to be repeated to increase and decrease with time.

4. An ion trap mass spectrometer according to claim 1, wherein said frequency is changed so that a rate of the change with time is constant.

5. An ion trap mass spectrometer according to claim 1, wherein said frequency is changed so that a rate of the change with time is changed.

6. An ion trap mass spectrometer according to claim 1, wherein said frequency is changed so that the change is repeated.

7. An ion trap mass spectrometer according to claim 1, wherein said frequency is changed in a step-shape.

8. An ion trap mass spectrometer comprising;

a ring electrode;

end cap electrodes arranged opposite to each other so that said ring electrode is interposed between the end cap electrodes;

a radio frequency power source for generating a radio frequency voltage applied to said ring electrode and said end cap electrodes so as to form a radio frequency electric field in an ion trap volume formed between said ring electrode and said end cap electrodes; and means for generating ions and injecting the ions into said ion trap volume during a predetermined period, the ions being injected into and trapped in said ion trap volume, the trapped ions being elected from said ion trap volume, wherein said radio frequency voltage applied between said ring electrode and said end cap electrodes is successively changed in frequency during said predetermined ion injection period.

9. An ion trap spectrometer according to claim 8, wherein said frequency of said radio frequency voltage is changed so as to be increased or decreased with time.

10. An ion trap mass spectrometer according to claim 8, wherein said frequency is changed so as to be repeated to increase and decrease with time.

11. An ion trap mass spectrometer according to claim 8, wherein said frequency is changed so that a rate of the change with time is constant.

12. An ion trap mass spectrometer according to claim 8, wherein said frequency is changed so that a rate of the change with time is changed.

13. An ion trap mass spectrometer according to claim 8, wherein said frequency is changed so that the change is repeated.

14. An ion trap mass spectrometer according to claim 8, wherein said frequency is changed in a step-shape.

15. An ion trap mass spectrometer comprising:

a ring electrode;

end cap electrodes arranged opposite to each other so that said ring electrode is interposed between the end cap electrode;

a radio frequency power source for generating a radio frequency voltage applied to said ring electrode and said end cap electrodes so as to form a radio frequency electric field in an ion trap volume formed between said ring electrode and said end cap electrodes; and a means for generating ions and introducing the ions into said ion trap volume during a first period, the ions being introduced into and trapped in said ion trap volume, the trapped ions being ejected from said ion trap volume during a predetermined second period, wherein a predetermined range of mass-to-charge ratio is divided into a plurality of divided ranges, said introduction of the ions during said first period and said emission of the ions during said second period being performed to each of said plurality of divided ranges, the frequency of said radio frequency electric field being successively changed while said introduction and said trapping of the ions are being performed during said first period of each of said plurality of divided ranges.

16. An ion trap mass spectrometer according to claim 15, wherein said frequency of said radio frequency electric field is changed in each of said plurality of divided ranges of said mass-to-charge ratio on bases of a different constant value.

17. An ion trap mass spectrometer comprising:

a ring electrode; and cap electrodes arranged opposite to each other so that said ring electrode is interposed between the end cap electrodes;

a radio frequency power source for generating a radio frequency voltage applied to said ring electrode and said end cap electrodes so as to form a radio frequency electric field in an ion trap volume formed between said ring electrode and said end cap electrodes; and a means for generating ions and injecting the ions into said ion trap volume during a predetermined injection period, the ions being introduced into and trapped in said ion trap volume, the trapped ions being ejected from said ion trap volume, wherein as a mass-to-charge ratio of ions to be injected is increased, the frequency of said radio frequency voltage is successively changed during said predetermined ion injection period so that a change speed of the amplitude during the ion injection period becomes higher.

* * * * *